United States Patent [19]

Mastrogiannis

[11] 4,310,070

[45] Jan. 12, 1982

[54] LIFTING AND DESCENT MECHANISM-CRIKET

[76] Inventor: Spiridon A. Mastrogiannis, 9, Hniohou St., Galatsi, Athens, Greece

[21] Appl. No.: 918,578

[22] Filed: Jun. 23, 1978

[51] Int. Cl.[3] ..... A63B 27/04

[52] U.S. Cl. ..... 182/134; 182/221; 182/214; 182/189

[58] Field of Search ..... 182/133, 134, 135, 136, 182/214, 221, 100, 189, 133-136, 100, 189

[56] References Cited

U.S. PATENT DOCUMENTS

| | | | |
|---|---|---|---|
| 952,720 | 3/1910 | Allen | 182/135 |
| 1,328,251 | 1/1920 | Poetz | 182/134 |
| 1,519,748 | 12/1924 | Aguilar | 182/135 |
| 1,918,293 | 7/1933 | Seiler | 182/134 |
| 2,311,352 | 2/1943 | Seiler | 182/136 |
| 2,327,317 | 8/1943 | Randall | 182/214 |
| 2,330,288 | 9/1943 | Hurley | 182/134 |
| 2,666,608 | 1/1954 | Holm | 182/214 |
| 2,736,526 | 2/1956 | Forbes | 182/136 |
| 3,075,611 | 1/1963 | Baringer | 182/134 |
| 3,200,904 | 8/1965 | Weeks | 182/134 |
| 3,317,971 | 5/1967 | Meyer | 182/5 |
| 3,968,858 | 7/1976 | Vollan | 182/136 |

*Primary Examiner*—Reinaldo P. Machado

*Attorney, Agent, or Firm*—Charles H. Lindrooth; Richard D. Weber

[57] ABSTRACT

A climbing mechanism is disclosed that comprises a central upright post with right and left foot pedal assemblies slidably disposed on right and left lateral sides of the post. Each pedal assembly is attached to a wedge-shaped slider that travels within a complementary shaped channel lengthwise of the post. Each pedal includes a foot-supporting sole portion and has a foot restraining strap. User-controlled pivoting of the pedals controls the mechanism that locks the pedals with respect to the post. Illustrative embodiments describe locking and unlocking arrangements wherein a projecting member affixed to each pedal assembly (such as a tooth or a cambered element) is controllably mated with a selected one of a plurality of sockets or recesses located lengthwise of the post. A further embodiment describes a locking and unlocking arrangement in which a braking member on each pedal assembly selectively positions each assembly through controllably gripping a cable disposed lengthwise of the post. Tension springs are included to urge the pedal into locked positions on the post. Adjustable crosspieces located at the top and bottom of the post provide support and footing. The device can optionally be constructed in take-apart form, with post segments joined together by coupling elements.

3 Claims, 12 Drawing Figures

LIFTING AND DESCENT MECHANISM-CRIKET

FIELD OF THE INVENTION

This invention relates generally to climbing appliances and in particular, to the type used by a person in ascending or descending.

DESCRIPTION OF THE PRIOR ART

Conventional climbing mechanisms that enable persons to ascend and descend are typically ladder appliances made of wood, metal or rope which are usually portable and consist generally of two upright and parallel long side pieces or posts joined at intervals by horizontal crosspieces or slats called "rungs". Prior art ladders with rungs exist in all shapes and configurations: simple, complicated, able to be dismantled, etc.

Existing ladders have many disadvantages. They are often bulky, voluminous objects that are heavy and difficult to manage. Considerable difficulty can be encountered in trying to stand or park a ladder at a particular desired location. Because firm footing is difficult to achieve on sloping and irregular terrain, ladders do not always offer safe support to the user. Furthermore, the conventional ladder user must stand on rungs whose small size and surface area offer little comfort or support.

OBJECTS AND ADVANTAGES

It is an important object of the current invention to provide a novel climbing mechanism that overcomes the above and other disadvantages of conventional structures.

The invention is aimed at providing a useful climbing device that offers the following features:

(1) compactness and light weight for easier user manageability;

(2) means for attaining firm footing on sloping and irregular terrains;

(3) sturdiness and comfort in operation through use of pedal or shoe assemblies that support the entire surface of the sole of the user's foot; and (4) the provision of means whereby the user can climb by taking upward or downward steps of a height convenient to the user and can conveniently rest or stop at any desired point along the length of the climbing device.

SUMMARY OF THE INVENTION

This invention contemplates the provision of a novel climbing device to support a person's feet during ascending and descending movements.

The apparatus of the invention comprises a main load-supporting post or beam to which at least one user supporting pedal or shoe assembly is attached for user-activated movement of the pedal or shoe along the length of the post. Means are provided by which the user can lock the pedal or shoe assembly at selected locations along the post. Bracing and leveling means are provided respectively at each end of the post to provide stable footing and support at the lower and upper ends of the post respectively. Extension members are provided to be suitably coupled to the post in order to extend the post to any desired length.

In its preferred embodiment discussed in further detail below, independently movable right and left foot pedal assemblies are disposed on opposite lateral sides of the post for user-controlled movement along the post. Each pedal comprises a foot supporting member or sole element suitably attached to a traveler or slider plate that moves along the side of the post within the confines of a guide channel. User-actuated gripping means are provided to alternately lock and unlock the position of each pedal assembly relative to the post at selected points along its length.

BRIEF DESCRIPTION OF THE DRAWINGS

The above and other advantages and uses of this invention will become apparent when considered in view of the following detailed description and drawings in which.

DESCRIPTION OF THE PREFERRED EMBODIMENTS

The general features of the invention are now described with reference to a first preferred embodiment of a climbing apparatus having right and left shoe pedal assemblies mounted for selective foot-supporting movement along opposite sides of an upright post member supported at upper and lower ends by adjustable crosspieces.

Figure 1:
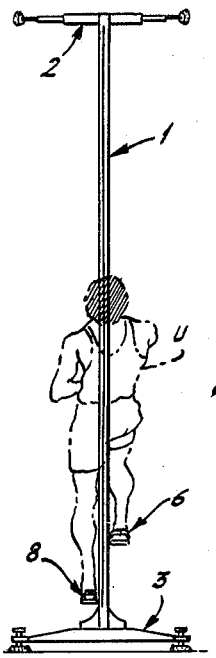
FIG. 1 is a front elevational view of a device embodying the invention, showing a user drawn in phantom to illustrate user position during operation.

Throughout this specification, directional references such as "upper", "lower", "right" and "left" will be made to parts of the device in accordance with their positional relationship relative to a user "U", shown in phantom in FIG. 1 with his or her back toward the reader. Such directional terminology is for clarity only and not intended to limit the broader aspects of the invention in any way.

In the embodiment of the invention shown in FIGS. 1–5, the apparatus comprises a generally vertical upright member or post 1 at whose upper and lower ends are disposed horizontal crosspieces 2 and 3, respectively. Right pedal assembly 6 is movably disposed on the right side of post 1, and left pedal assembly 8 is movably disposed on the left side of post 1.

To avoid repetition, a detailed consideration will be given only to the right pedal assembly 6 with a description of the corresponding details of left pedal assembly 8 being omitted. It is to be understood that the construction, function and operation of pedal assembly 8 will be the same as that of right pedal assembly 6.

Figure 2:
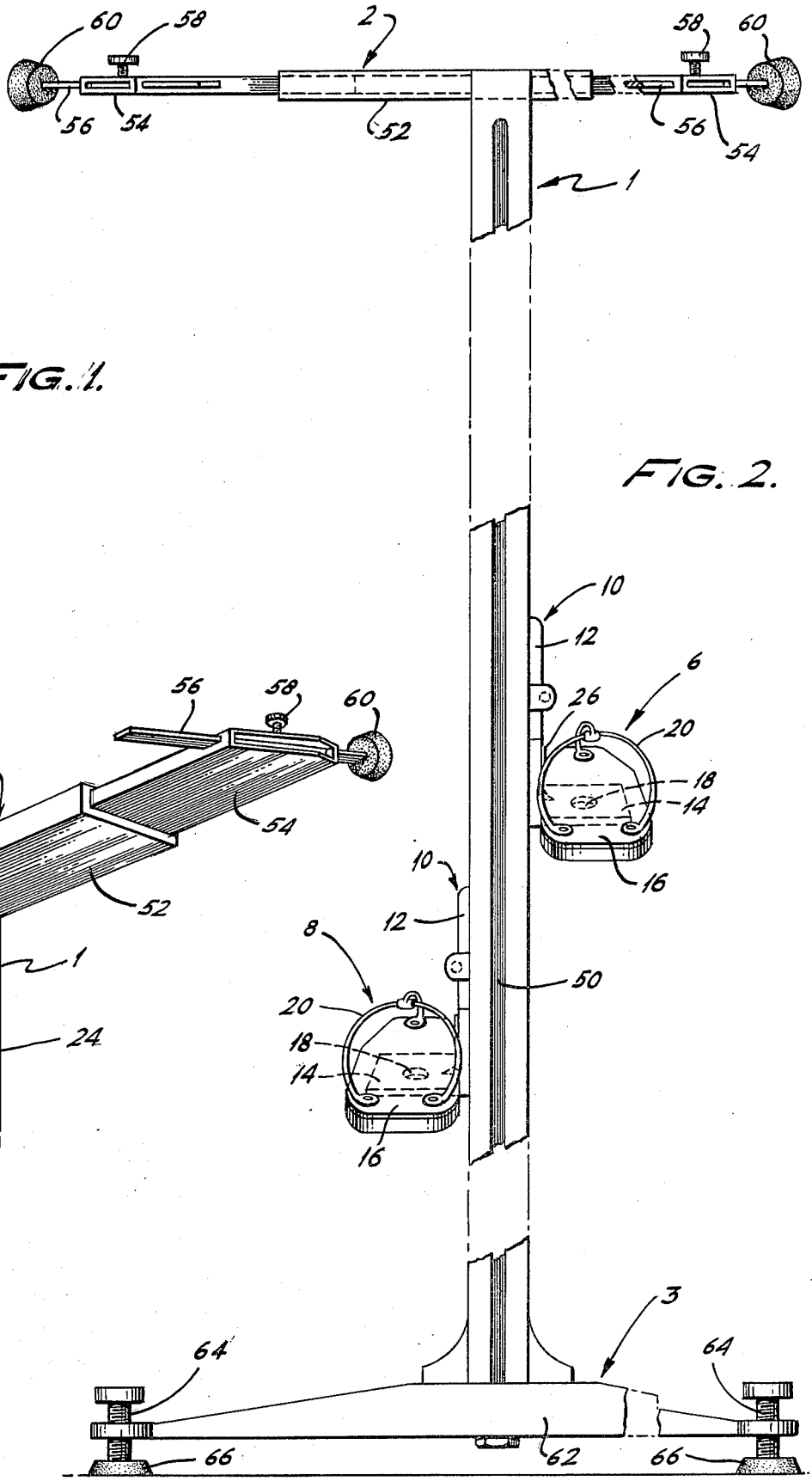
FIG. 2 is an enlarged front elevational view of the device of FIG. 1 with portions broken away, showing the details of the pedal assembly and locking mechanism and of the post bracing and supporting structure.
Figure 5:
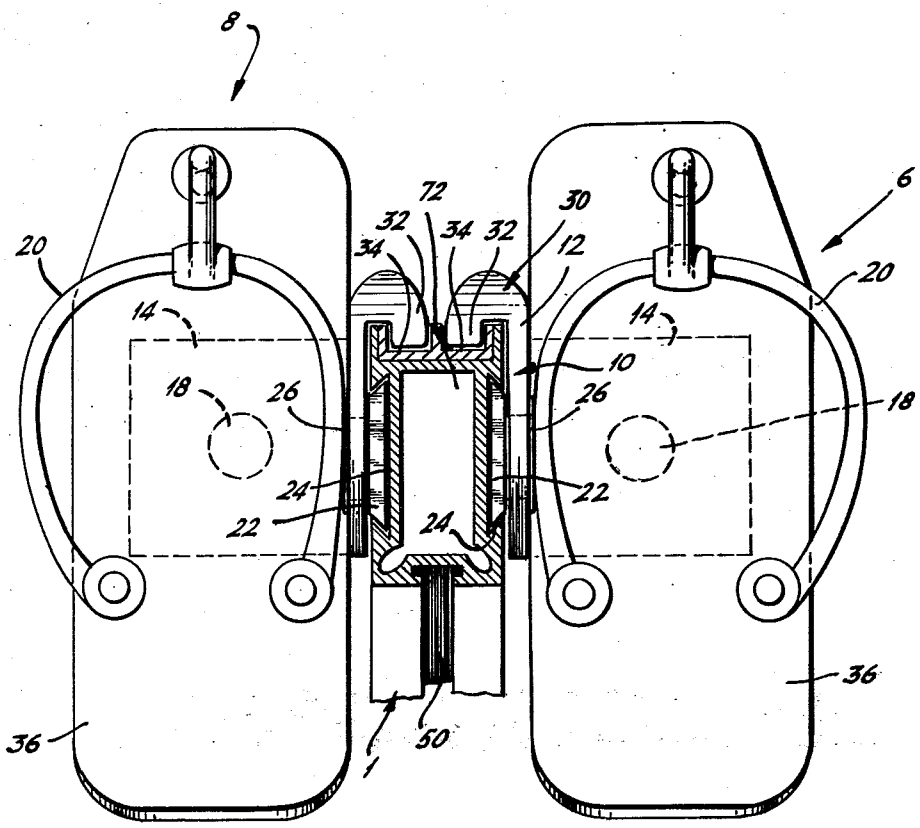
FIG. 5 is a sectional view taken on the line 5—5 of FIG. 4, with right and left shoe assemblies brought even for clarity of illustration.

Right pedal assembly 6 (See FIGS. 2, 4 and 5) comprises a generally "L"-shaped body member 10 having a vertical upper portion 12 and horizontal, generally planar lower portion 14 (shown in dashed lines in FIGS. 2 and 5). A foot-supporting member, such as sole or base element 16 is suitably mounted on top of horizontal portion 14 of body member 10, such as by means of a bolt passed through hole 18 of portion 14. Means, such as foot retaining strap 20, is provided to retain the user's foot on base element 16.

Figure 4:
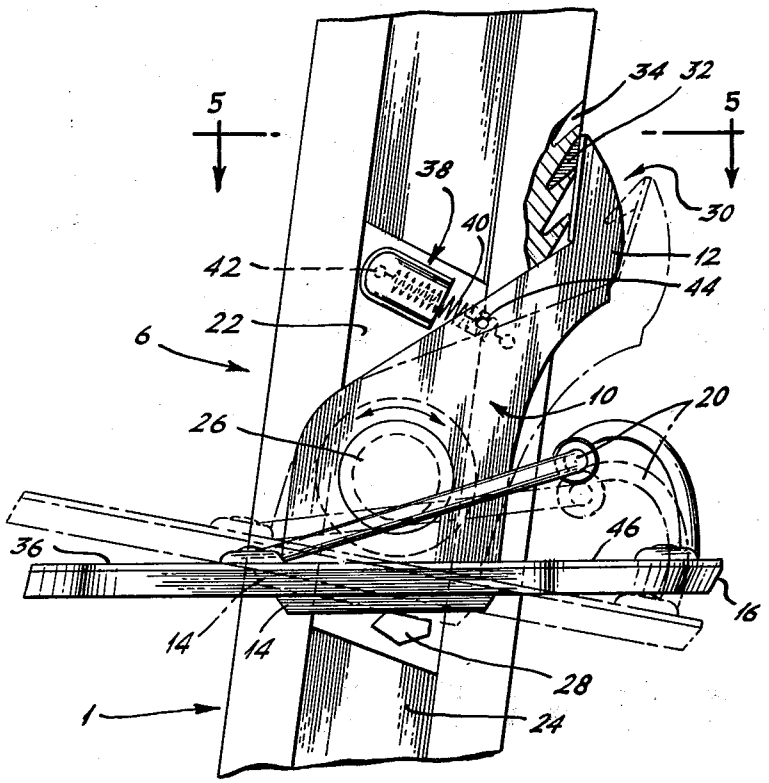
FIG. 4 is an enlarged fragmentary right side elevational view showing details of the pedal assembly and locking mechanism of the embodiments of FIGS. 1–3, with portions of the post cut away for clarity of illustration, the locked position of the right pedal assembly being indicated by solid lines and the unlocked position of the right pedal assembly being indicated by dot-and-dash lines.

Body member 10 is mounted on post or beam 1 for translational movement generally parallel to the longitudinal axis of the post. FIGS. 4 and 5 illustrate a suitable fastening means comprising a wedge-shaped sliding member 22 positioned for sliding movement within a complementary shaped channel 24 disposed on the right side of post 1. Body member 10 as shown in FIGS. 4 and 5 is fastened to slider 22 by means of a suitable fastener such as bolt 26 and vertical movement of body member 10 will accordingly produce corresponding vertical movement of slider 22. Bolt 26 serves in addition to allow body member 10 to pivot with respect to slider 22 about the axis of bolt 26 (See FIG. 4). Such pivotal movement is limited by the positioning of stop lug 28 (FIG. 4) on slider 22 at a point below the lower portion 14 of body member 10.

At the upper end 12 of body member 10 is located a locking and unlocking means 30 (FIG. 4) by which the vertical movement of pedal assembly 6 with respect to post 1 can be selectively locked at any desired one of a plurality of locations on post 1. A first preferred form of locking and unlocking means comprises one or more projecting members or teeth 32 formed at upper portion 12 of body member 10 which can be selectively interengaged with corresponding recesses or sockets 34 disposed longitudinally of a portion of post 1. FIG. 4 illustrates in partial cutaway a locking and unlocking mechanism utilizing such a tooth 32 and receiving sockets 34 with the sockets disposed in the back edge of post 1. FIG. 5 shows the location of the two series of sockets 34 for locking the right and left pedal assemblies 6 and 8 with respect to post 1. Both the tooth 32 and sockets 34 incline downwardly and inwardly so that the position of the pedal assembly with respect to post 1 is locked when weight is placed on the back or heel portion 36 of sole element 16 (See FIG. 4). Biasing means 38 urges tooth 32 into locking engagement with respect to sockets 34. The illustrated biasing means 38 (FIG. 4) comprises a tension spring 40 extending between attach point 42 on slider 22 and spring and attach point 44 located on an intermediate portion of vertical piece 12 of body member 10.

Pedal assembly 6 is unlocked for upward or downward movement along post 1 by tilting the toe or front part 46 of sole 16 forward while raising the assembly, whereby body member 10 pivots clockwise about the axis of fastener 26, and tooth 36 disengages from its corresponding socket 34 in post 1. Thus for ascending, the user raises his foot upward against restraining strap 20 (FIG. 2) while pointing his toes down to tilt the assembly forward to the dot-and-dash position of FIG. 4. This frees the tooth from the socket thereby permitting upward movement of body member 10 and slider 22 along post 1. The position of right pedal assembly 6 with respect to post 1 is relocked when the user again shifts his weight back to his heel (i.e. the heel portion 36 of sole 16) which, together with the restoring force of tension spring 40, pivots the assembly back to the solid line position of FIG. 4, and mates tooth 32 into engagement with one of the sockets 34 at a newly selected location along post 1. A similar operation is followed in descending, with the slider following the downward movement of the user's foot. To initiate each downward step the assembly is first raised and rotated to free the tooth 32, and the user keeps his toes pointed down until he is ready to relock the pedal.

Stop 28 (FIG. 4) limits the extent of pivotal movement of body member 10 about the axis of bolt 26. Biasing means 38 and the need for upward movement of the assembly to free the tooth serve to prevent accidental slippage or disengagement of the pedal assembly from its locked position. A channel 50 (FIGS. 2 and 5), preferably located axially on the front edge of post 1, is used to accommodate a safety catch or bolt which can slide in the channel as the user climbs and descends and provides an additional safety measure.

The configuration of the left pedal assembly 8 and its means of slidable attachment to a corresponding left side channel 24 of post 1 is the same as the structure and interengagement just described with respect to right pedal assembly 6.

Figure 3:
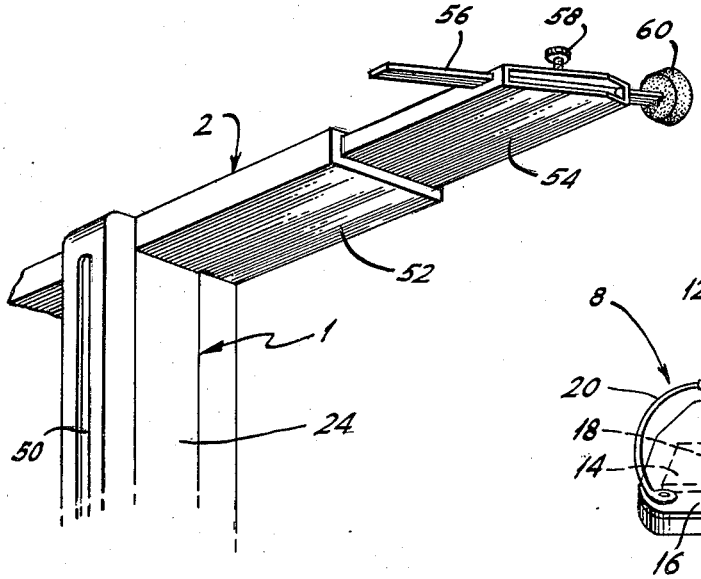
FIG. 3 is a fragmentary perspective view showing details of the right portion of the upper horizontal crosspiece of the embodiments of FIGS. 1 and 2.

FIGS. 2 and 3 illustrate the means for supporting the post in an upright position, and show the detailed features and characteristics of upper horizontal crosspiece assembly 2 and lower horizontal crosspiece assembly 3. Upper horizontal crosspiece assembly 2 (FIG. 2) comprises an elongated rectangular body element 52 suitably fastened to the top of post 1 so that it extends perpendicularly from the right and left sides of post 1. The back side of element 52, as shown in FIG. 3, is essentially flush with the back side of post 1. At the right and left ends of rectangular element 52 are located adjustable extension pieces 54, which are telescopingly received into element 52 at its ends. At the end of each extension piece 54 is located an adjustable rest support 56 which is selectively fixed in its relationship to extension piece 54 by means of a suitable fastening means such as locking screw 58. At the front end of each rest support 56 is disposed a pad, such as cushioning piece 60. In operation, when post 1 is elevated for climbing with respect to a wall or other structure, extension pieces 54 and adjustable rest supports 56 are adjusted so that cushioning pieces 60 come into firm supporting contact with the wall or other structure being scaled. The telescoping feature of extension 54 is especially advantageous to position cushioning piece 60 on solid support away from glass window panes and openings. Each rest support 56 is outwardly angled with respect to its supporting extension piece 54 to provide increased stability against lateral movement.

The details of lower horizontal crosspiece or base assembly 3 are shown in FIG. 2. The base of the post is received into a tapered member 62 which is supported at each end by leveling screws 64 whose heights can be adjusted to provide firm footing on uneven and irregular terrains. Resting pads 66 are located (FIG. 2) at the ends of right and left leveling screws 64, respectively. Other arrangements such as struts, cables, wires, etc., can be utilized in conjunction with or in place of the upper and lower crosspieces described for supporting the post.

Figures 9, 10, 11, 12:
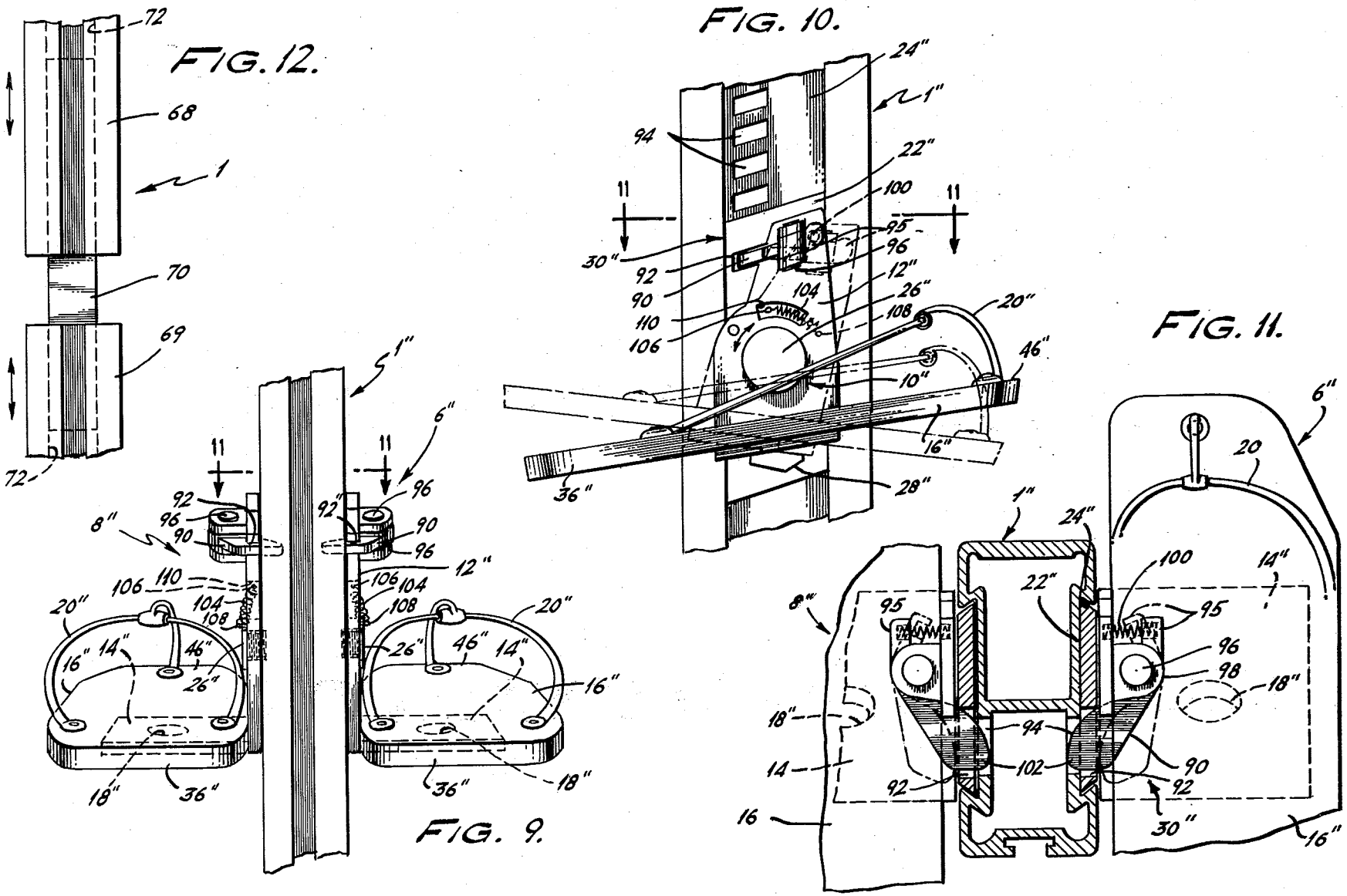
FIG. 9 is an enlarged fragmentary elevational view of a further modified form of the invention showing the details of a third embodiment of pedal assembly and locking mechanism in a view generally corresponding to FIGS. 2 and 6, with right and left pedals brought even for clarity of illustration.
FIG. 10 is a fragmentary right side elevational view of the device of FIG. 9, generally corresponding to FIGS. 4 and 7, showing the locked position of the right pedal assembly in solid lines and the unlocked position in dot-and-dash lines.
FIG. 11 is a fragmentary sectional view taken along the line 11—11 of FIG. 10, with portions of parts omitted for clarity of illustration, showing the locked positions of the right and left pedal assemblies in solid lines and the unlocked positions in dot-and-dash lines.
FIG. 12 is a fragmentary front elevational view illustrating the interconnection of post pieces using a coupling element.

To provide portability to the climbing device, post member 1 can be optionally configured to be taken apart in sections along its length. Provision may be made for adding additional post sections or extension pieces to the end of the post member to extend it to any desired length. FIG. 12 illustrates a suitable coupling means by which assembly and disassembly of the various sections of the post can be accomplished. As illustrated in FIG. 12, a first section 68 of post 1 can be brought into alignment with a second section 69 of post 1 and joined thereto by a suitable coupling element 70 that can take the form of any known coupling means and is disposed, for example, within cavity 72 (See also FIG. 5) located in the hollow center portion of each of sections 68 and 69.

Operation and use of the climbing device is as follows. After the portable device has been assembled with the crosspieces 2 and 3 attached thereto so that the whole bears a generally "I"-shaped configuration (FIG. 1), the user adjusts the leveling bolts 64 and the rest supports 56 for proper support. With the climbing device in place with respect to the wall or other surface to be scaled, the user puts his right and left feet respectively onto the right and left pedal assemblies 6 and 8 (FIG. 1), so that the bottom of each foot is supported on the foot supporting member or sole 16 of the respective right or left pedal assembly and the top of each foot is restrained within the confines of the respective right or left foot strap 20 (FIG. 2). Grasping the post 1 with his hands, the user alternately raises one foot and then the other to ascend the post. At each step, the user lifts his right or left foot up, drawing the pedal assembly upwards by means of the restaining strap 20.

As he raises his right foot, the user tilts his toes down. This causes downward tilting of toe surface 46 of sole 16 which in turn causes clockwise pivoting (to the dot-and-dash position of FIG. 4) of the "L"-shaped body member 10. The tooth 32 is thus "unlocked" from its corresponding socket 34 thereby permitting the pedal assembly to be raised, moving slider 22 upwardly within channel 24. Before the climber lifts his left foot, he shifts his body weight onto his right heel and thus onto the heel portion 36 of right sole element 16, bringing the right pedal assembly again into locking engagement with post 1 at a new location above the right foot starting position. The same process is then repeated for the left foot and continues alternately with right and left foot movements until the user has reached the desired point of ascent along post 1. The user determines the pedal travel for each step and can therefore use any size step that seems comfortable and natural to him.

Upon descent, the process is similar. The climber moves his right and left feet alternately upwards while tilting his foot forwards, unlocking the corresponding pedal assembly 6 or 8 from the post. Keeping his foot tilted forwards, he takes the desired downward step. When he again shifts his weight back to the heel of his foot after the desired downward step, tooth 32 is mated to a different socket 34 under the urging of tension spring 40, thereby relocking the mechanism. The inward and downward incline of tooth 32 and sockets 34 prevents the accidental release of the pedal assembly should the user inadvertently put his weight on his toes. Because of the inclination, upward movement is required for unlocking.

Figure 8:
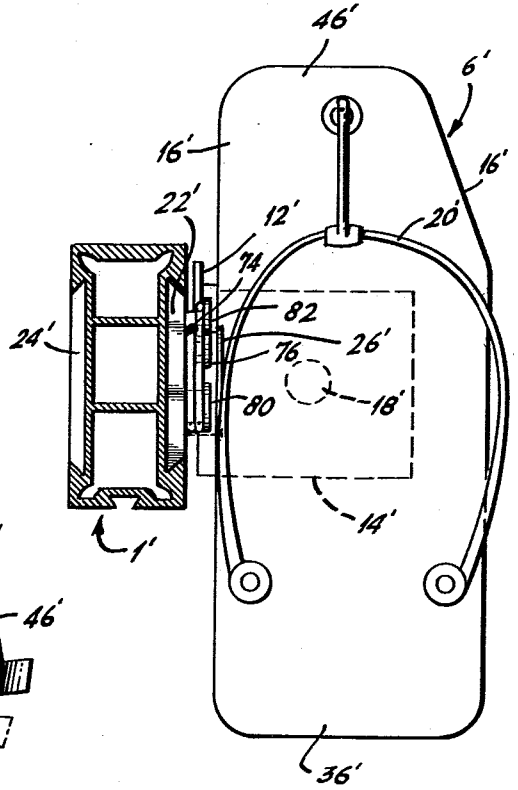
FIG. 8 is a sectional view taken on the line 8—8 of FIG. 7 with the left pedal assembly omitted for clarity of illustration, in a view generally corresponding to FIG. 5.
Figure 7:
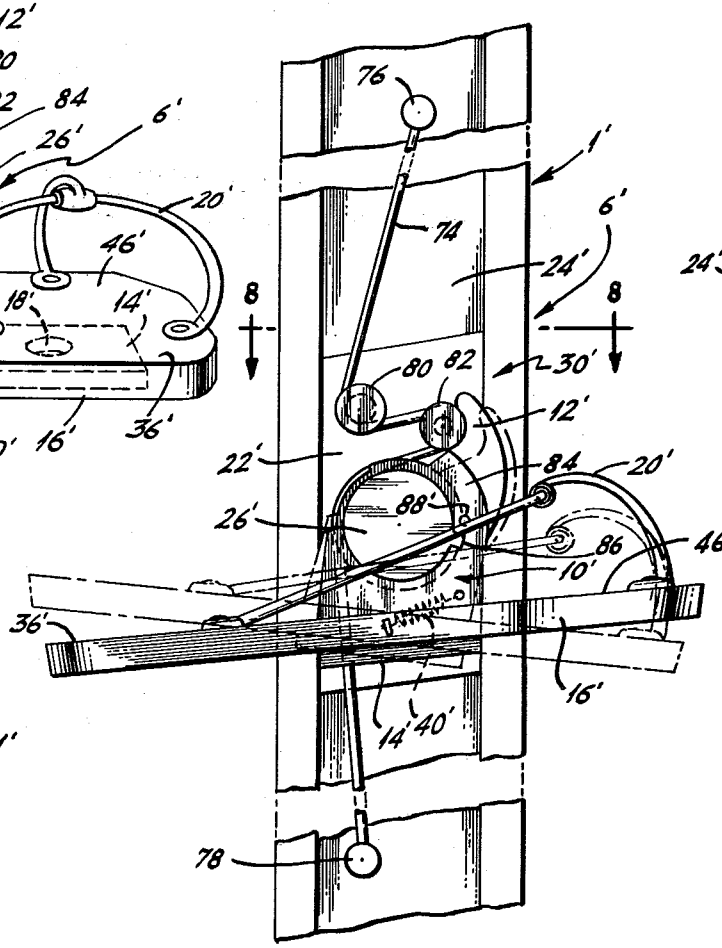
FIG. 7 is a fragementary right side elevational view of the device of FIG. 6 generally corresponding to FIG. 3, showing the locked position of the right pedal assembly in solid lines and the unlocked position in dot-and-dash lines.
Figure 6:
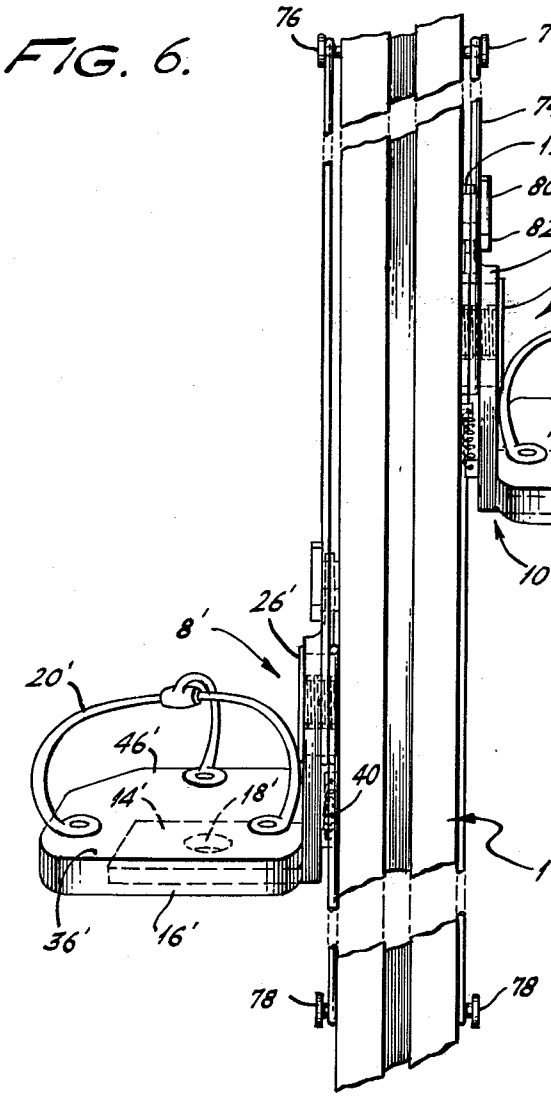
FIG. 6 is an enlarged fragmentary front elevational view of a modified form of the invention, showing the details of a second embodiment of pedal assembly and locking mechanism in a view generally corresponding to FIG. 2.

FIGS. 6 through 8 illustrate a modified embodiment of the invention, showing right and left pedal assemblies 6′ and 8′ with associated locking and unlocking means 30′. As shown in FIG. 7, flexible cord or cable 74 runs along channel 24′ from cable post 76 to a second cable post 78. The cable is wound around two guides 80 and 82 located on slider member 22′ and around the periphery of fastener 26′ connecting slider 22′ to body member 10′, the fastener 26′ including a circular rim portion 84 around a part of which the cable 74 slides. Body member 10′ includes at its upper end a braking member 12′ which is formed to mate with an inner portion of guide 82 so that cable 74 is securely gripped between curved portion 12′ and guide 82 when the climber's weight is placed on the heel portion 36′ of sole 16′.

Body member 10′ is pivotally mounted to slider 22′ by means of fastener 26′, as described previously for the foregoing embodiment. However, a stop member or projection 86 located on the periphery of fastener 26′ abuts a post 88 on the exposed portion of body member 10′ when pivoted in the clockwise direction (FIG. 7) so as to limit the clockwise movement of the pedal.

In operation, the user tilts his foot forward to apply clockwise pivoting motion to the pedal assembly 6′ (moving pedal assembly 6′ to the dot-and-dash position shown in FIG. 7) which disengages braking member 12′ from its clamping position. The slider 22′ is thus rendered free to follow the upward movement of the user's foot. During the upward movement, the flexible cable 74 moves around the guides 80 and 82. When the user shifts his weight to his heel (i.e., to heel portion 36′ of sole 16′), braking member 12′ of body member 10′ is again brought into pressure-exerting contact against cable 74 and guide 82. This stops the slippage of cable 74 around guides 80 and 82 and the shoe assembly 6′ is again locked in position with respect to post 1′. This operation is then repeated for the other foot, and so forth.

The downward movement proceeds in a similar fashion. The user shifts his weight to the toe portion 46′ of sole 16′ by pointing his toes down. This releases the braking member 12′ from contact with cable 74 and frees slider 22′ for desired downward movement. The pedal is relocked with respect to the post when the user shifts his weight to his heel (i.e., heel portion 36') once again.

Biasing means, such as a spring arrangement 40' (FIGS. 6 and 7) is provided between the slider 22' and the body member 10' to urge braking member 12' of body member 10' toward clamping contact with cable 74 and guide 82.

FIGS. 9 through 11 show the details of a further embodiment of the invention, including a pedal assembly 6" having a locking and unlocking means 30". A projecting member 90 (FIGS. 9 and 11) suitably fastened to an upper portion 12" of body member 10" projects through an opening 92 (FIG. 11) in slider 22" to mate with a selected one of a plurality of holding means, such as recesses or slots 94 (FIGS. 10 and 11), located on the interior of channel 24". The slots 94 are spaced longitudinally of post 1" within channel 24" so that locking of pedal assembly 6" may be obtained at selected positions along post 1" by user-controlled mating of projecting member 90 of pedal 6" with a selected one of the slots 94.

Projecting portion 90 has an end 95 thereof which is suitably fastened by means of a hinge pin 96 to lug 98 for pivotal movement of the projecting member 90 about the axis of bolt pin 96 (FIG. 11). Biasing means such as compression spring 100 (FIG. 11) is provided to urge projecting member 90 into locking contact with a slot 94, thereby encouraging pedal assembly 6" to be in a locked position with respect to post 1".

The leading edge 102 of projecting member 90 is cambered, and positioned so that clockwise movement of sole 16" and base 10" about fastener 26" (to the dot-and-dash position shown in FIG. 10) will bring projecting member 90 out of contact with slot 94 and through opening 92 in slider 22" (dot-and-dash position in FIG. 11), thus releasing the pedal 6" and slider 22" for user-controlled movement upwards or downwards in channel 24".

Suitable biasing means is provided between body member 10" and slider 22" to bias sole member 16" in the counterclockwise direction (as viewed in FIG. 10). The biasing means as shown in FIG. 10 comprises a tension spring 104 extending through arcuate opening 110 from attach point 106 on slider 22" to attach point 108 on body member 10". Pivotal movement of body member 10" is limited by stop lug 28" (FIG. 10).

The operation of the climbing mechanism using the pedal assembly 6" and locking/unlocking mechanism 30" of FIGS. 9 through 11, is similar to the operation of the previously described embodiments. Unlocking occurs as the user's weight is shifted to the front of sole element 16", and locking occurs when the weight is shifted back to the heel portion of sole member 16". FIGS. 10 and 11 show the unlocked position of the right pedal assembly in dot-and-dash lines and the locked position of the assembly in solid lines.

The foregoing specific embodiments of the invention are presented by way of illustration and not by way of limitation of the many uses and purposes of this invention. There are many modifications and variations of the above that can also produce a suitably usable system. For example, in its usual form (as illustrated) the invention would comprise a portable climbing mechanism which is supported on an underlying surface and rests at its upper end against a wall or other structure. However, in an obvious variation the load-supporting post member may be permanently attached in a vertical disposition to the side of a structure such as a storage tank, warehouse bin, stack, tower, etc. For such installation, upper and lower crosspieces have to be omitted and brackets added to secure the post to the structure at vertical intervals.

The invention provides a portable, lightweight climbing device that can serve as a replacement for clumsy and heavy conventional ladders. Means are provided so that good footing can be obtained on irregular and uneven terrain and good resting abutment can be obtained against a building, wall or other structure. The wide surface area of the foot supporting elements of the pedal assemblies provides a comfortable, non-fatiguing support for the user. The locking and unlocking mechanism permits the user to climb with comfortable stepping increments.

I claim:

1. A climbing mechanism, comprising a load-supporting post member, means for supporting said post member in a generally upright disposition, a pair of foot-supporting pedal assemblies slidably attached to said post member for movement along the length of said post member, means for selectively locking and unlocking each of said pedal assemblies with respect to said post member, a first cable post attached adjacent the upper end of said post member, a second cable post attached adjacent the lower end of said post member, a flexible cable extending between said first and second cable posts, said cable running lengthwise and generally parallel to said post member, said means for selectively locking and unlocking each of said pedal assemblies comprising means on each of said pedal assemblies for selectively gripping and ungripping said cable.

2. The invention as claimed in claim 1, wherein said means for selectively locking and unlocking each of said pedal assemblies further comprises means actuated by pedal movement of each of said pedal assemblies.

3. The invention as claimed in claim 1 including biasing means urging said means for selectively locking and unlocking each of said pedal assemblies into the locked position.

* * * * *